US005289591A

United States Patent [19]

Andersen

[11] Patent Number: 5,289,591

[45] Date of Patent: Mar. 1, 1994

[54] HARD BALL GOLF HAT

[76] Inventor: Kelvin D. Andersen, 303 E. 60th St., New York, N.Y. 10022

[21] Appl. No.: 765,553

[22] Filed: Oct. 25, 1991

[51] Int. Cl.[5] ..... A42B 3/12

[52] U.S. Cl. ..... 2/411; 2/195.5; 2/209.13; 2/425

[58] Field of Search ..... 2/196, 199, 411, 171.1, 2/181, 181.4, 181.6, 182.8, 185 B, 185 C, 185 R, 190, 209.1, 410, 425

[56] References Cited

U.S. PATENT DOCUMENTS

| | | | |
|---|---|---|---|
| 1,105,400 | 7/1914 | Burke | 2/196 |
| 1,789,188 | 1/1931 | McGuigan | 2/185 B |
| 3,153,792 | 10/1964 | Marietta | 2/190 |
| 3,268,911 | 8/1966 | Cox | 2/181.4 |
| 4,020,507 | 5/1977 | Morton | 2/411 |
| 4,101,983 | 7/1978 | Dera | 2/425 |
| 4,131,953 | 1/1979 | Kimotsuki | 2/171.1 |
| 4,599,752 | 7/1986 | Mitchell | 2/425 |
| 4,864,662 | 9/1989 | Frank | 2/197 |
| 4,982,451 | 1/1991 | Graham | 2/411 |
| 5,123,121 | 6/1992 | Broersma | 2/425 |

FOREIGN PATENT DOCUMENTS

| | | | |
|---|---|---|---|
| 2236547 | 2/1974 | Fed. Rep. of Germany | 2/411 |
| 2335168 | 7/1977 | France | 2/411 |
| 2201330 | 9/1988 | United Kingdom | 2/411 |

*Primary Examiner*—Clifford D. Crowder
*Assistant Examiner*—Diana L. Biefeld
*Attorney, Agent, or Firm*—Auslander & Thomas

[57] ABSTRACT

A protective plastic insert is provided for a conventional golf cap. The insert is substantially hemispherical and is engagable within the cap. The cap is size adjustable. The insert adapts to the size change of the cap. Thus a single size insert fits most golf caps. The shape and hardness of the plastic protect the wearer against the impact of a stray golf ball.

17 Claims, 4 Drawing Sheets

FIG. 1
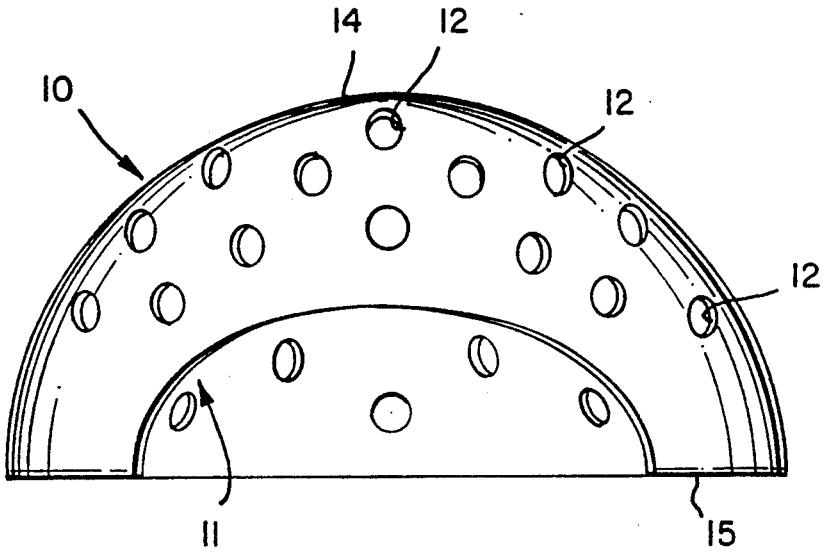
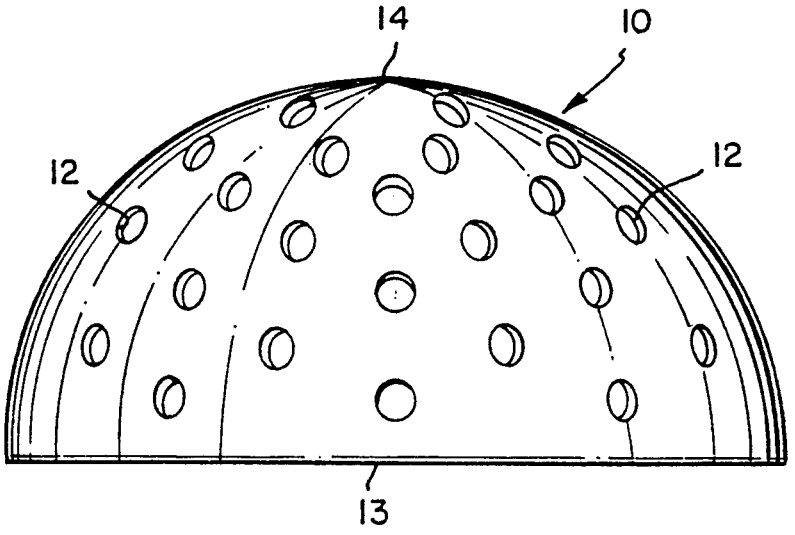
FIG. 2

FIG. 3
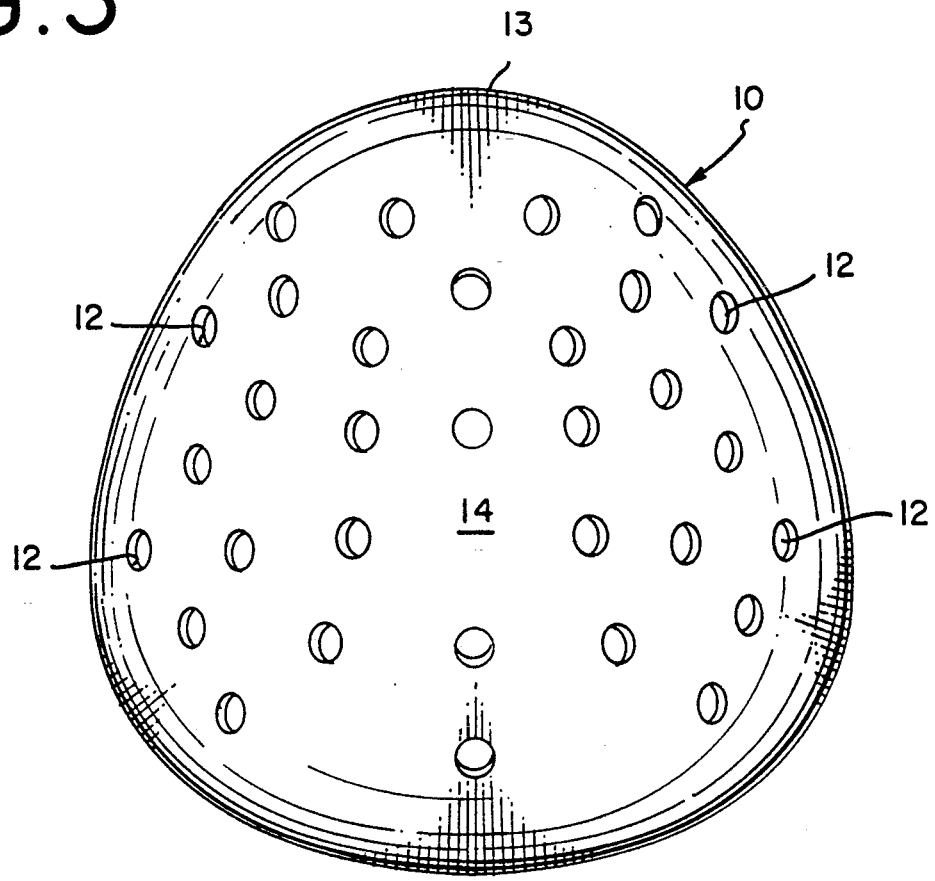
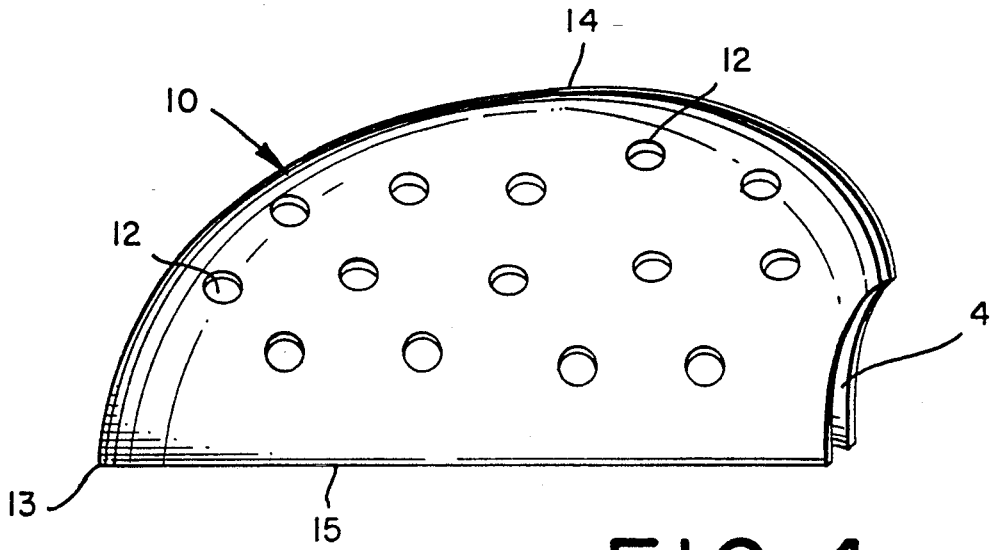
FIG. 4

FIG.6
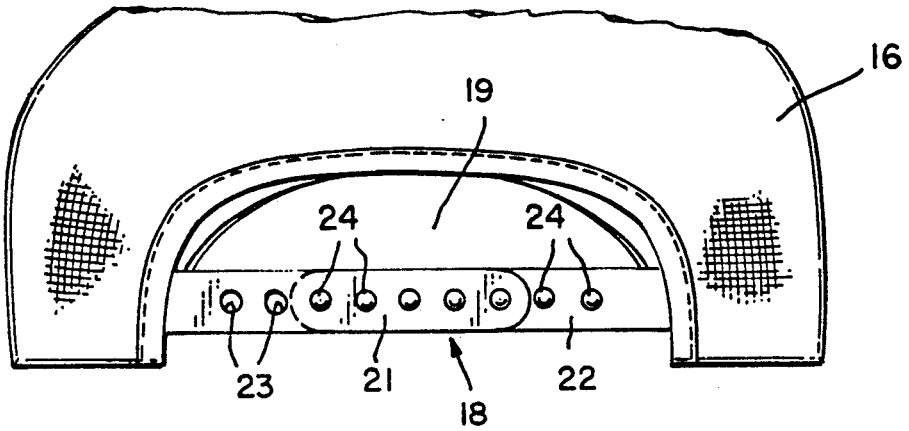
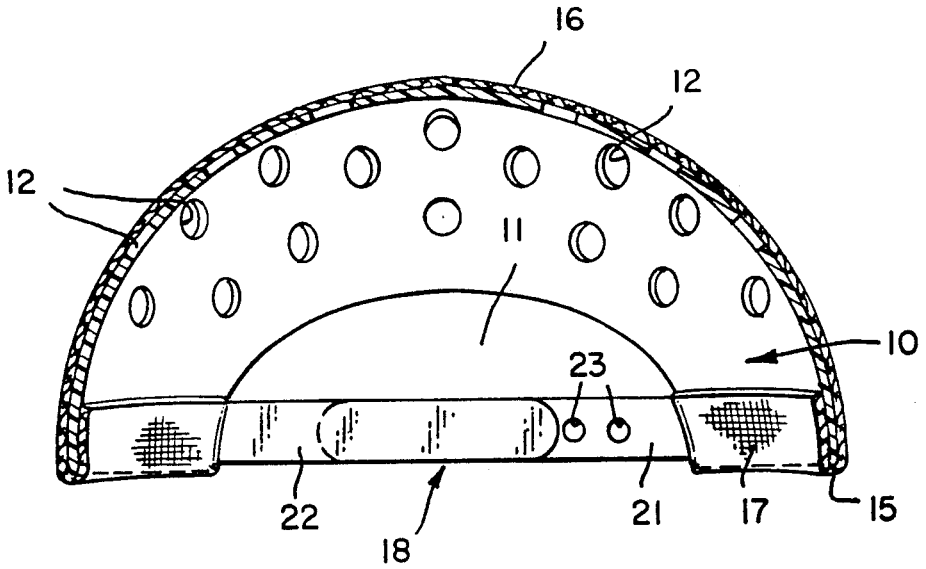
FIG.5

HARD BALL GOLF HAT

BACKGROUND OF THE INVENTION

1. Field of the Invention

The present invention is in the field of safety headwear for golfing.

2. Description of the Prior Art

The prior art discloses many safety headwear devices for protecting the head in various sporting and industrial activities. The devices of the past have oftentimes been hard, protective outer structured to protect the head and/or inserts into existing structures, so as to protect the head.

SUMMARY OF THE INVENTION

The present invention is a molded plastic hemispherical plastic dome to fit into a standard golf or baseball cap. The protective plastic insert for a golf cap is to be worn on the golf course to protect the wearer's head from the direct impact of a stray golf ball hit by another golfer.

The present invention provides a simple protective, modular insert, usable with a conventional golf cap, to protect the wearer, particularly from being hit by a golf ball.

DESCRIPTION OF THE PREFERRED EMBODIMENT

The present invention is a substantially hemispherical plastic dome designed and molded in one eighth inch plastic to fit the shape of the human head. (FIG. 1).

It is held in place by inserting it into the inside of a normal golf or baseball cap, the return binding of the cap flaps over the edges of the plastic insert holding it in place in under the crown of the cap.

It transforms a regular golf or baseball cap into protective headgear without changing the outward appearance of the cap. Except for a little extra weight and stiffness, it will feel almost like a regular cap and look like one.

It has a cut out at the rear (FIG. 1 and FIG. 4) for size adjustment which allows a caps own sizing strap to operate.

It also incorporates some thirty ventilation holes.

BRIEF DESCRIPTION OF DRAWINGS

FIG. 1. The protective plastic insert viewed from the rear showing sizing cut out and ventilation holes.

FIG. 2. The protective plastic insert viewed from the front showing ventilation holes.

FIG. 3. The protective plastic insert viewed from above showing ventilation holes.

FIG. 4. The protective plastic insert viewed from the side showing ventilation holes and turned a little to display the sizing cut out at the rear.

FIG. 5. Is a section view of the protective plastic insert engaged in a cap is showing the sizing existing cut out and sizing strap of the cap.

FIG. 6. Is a detail rear view of FIG. 5.

BRIEF DESCRIPTION OF THE FIGURES

Figure 7:
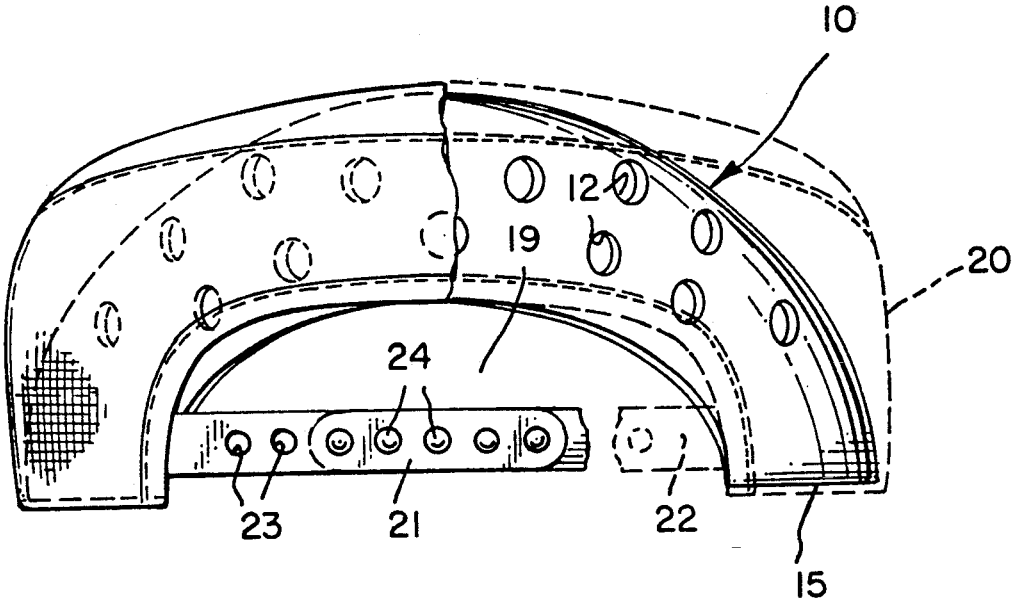
FIG. 7. Is a detail rear view of the protective plastic insert engaged in another existing cap, in phantom, showing the sizing cut out, vent holes and sizing strap of the cap.

The hemispherical plastic dome 10, as shown in the Figures, preferably has a plastic thickness of 0.0625.

The width of the hemispherical plastic dome 10 is approximately 7.5 inches from side to side and the hemispherical plastic dome 10 has a height of approximately 3.75 inches from its base to its top. The hemispherical plastic dome 10 curves from the front, the curvature starting from the front 13 to the top 14 of the hemispherical plastic dome 10, so that the end of the front curvature on the top is approximately 5 inches from a vertical line from the front 13 of the hemispherical plastic dome 10. The base 15 of the hemispherical plastic dome 10, as can be seen in FIG. 4, base 15 extends approximately 7.25 inches from the front portion 13 to the cutout 11.

The cutout 11, as can be seen in FIGS. 1 and 4, extends approximately 1.75 inches from the base 15 to the top of the cutout 11. The hemispherical plastic dome 10 curves downward from the top 14 in a regular curve to the highest point of the cutout 11. FIG. 1, shows the cutout 11 which is approximately 5 inches in width.

As can be seen in FIG. 3, the hemispherical plastic dome 10 is substantially rounded but conforms to the normal shape of the head. There are approximately 30 ventilation holes 12 which are preferably 3.75 inches in diameter and are substantially evenly distributed about the hemispherical plastic dome 10, preferably in sets, to ventilate the left and right sides of the hemispherical plastic dome 10 and the rear portion of the hemispherical plastic dome 10.

As can be seen in FIG. 5, the hemispherical plastic dome 10 is engaged in an existing cap 16. The base 15 of the hemispherical plastic dome 10 is engaged between the outside of the cap 16 and the return 17.

The adjustable trap of the existing cap 16 extends across the cutout 11 across the cap cutout 19, as can best be seen in FIG. 6.

As shown in FIG. 7, in phantom, the rear of the existing cap 20 has a slightly different configuration with a strap 18 and a cap cutout 19.

The strap 18 is adjustable, having a first strap portion 21 and a second strap portion 22. The straps 21 and 22 have respective female portions 23 and male portions 24, which selectively interengage to adjust the circumference of the existing caps 16, 20 and the hemispherical dome 10 across the respective cutouts 11 and 19.

I claim:

1. A plastic safety insert for a soft sports cap in combination with said sports cap, said plastic safety insert including a hemispherical dome, said dome substantially conforming to the shape of a human head, said plastic safety insert having a bottom portion, said bottom portion substantially on a plane, said plastic safety insert having a rear portion, said dome further substantially conforming to the shape of said sports cap, said plastic safety insert including a sizing cut out, said sizing ut out curved and extending upward from said bottom portion at said rear portion of said plastic safety insert, said cut out substantially spanning said rear portion, and said sports cap including a crown having a size; means at a backside of the sports cap to adjust the size of the crown; and a return binding to act as a flap to fit over the edge of said dome, whereby said plastic safety insert when inserted within said return binding in said sports cap is held in place under said crown of said sports cap maintaining the outward appearance of said sports cap.

2. The invention of claim 1 wherein said sports cap means to adjust the size of the crown includes a sizing strap.

3. The invention of claim 1 wherein said plastic safety insert includes vent holes.

4. The invention of claim 1 wherein said plastic safety insert includes a plurality of substantially evenly spaced vent holes.

5. The invention of claim 4 wherein said plastic safety insert includes approximately thirty vent holes.

6. The invention of claim 1 wherein said plastic safety insert is approximately one eighth of an inch thick.

7. The invention of claim 1 wherein said plastic safety insert is approximately one sixteenth of an inch thick.

8. The invention of claim 1 wherein said sizing cut out is approximately five inches wide.

9. The invention of claim 1 wherein said sizing cut out is approximately one and three quarter inches high.

10. A plastic safety insert for a soft sports cap having a crown with a size and means at a backside to adjust the size of the crown and a return binding to act as a flap to fit over the edge of said plastic safety insert, said plastic safety insert including a hemispherical dome, said dome substantially conforming to the shape of a human head, said plastic safety insert having a bottom portion, said bottom portion substantially on a plane, said plastic safety insert having a rear portion, said dome further substantially conforming to the shape of a sports cap, said plastic safety insert including a sizing cut out, said sizing cut out curved and extending upward from said bottom portion at said rear portion of said plastic safety insert, said cut out substantially spanning said rear portion, whereby said plastic safety insert when inserted within said return binding in said sports cap is held in place under said crown of said sports cap maintaining the outward appearance of said sports cap.

11. The invention of claim 16 wherein said plastic safety insert includes vent holes.

12. The invention of claim 16 wherein said plastic safety insert includes a plurality of substantially evenly spaced vent holes.

13. The invention of claim 12 wherein said plastic safety insert includes approximately thirty vent holes.

14. The invention of claim 10 wherein said plastic safety insert is approximately one eighth of an inch thick.

15. The invention of claim 10 wherein said plastic safety insert is approximately one sixteenth of an inch thick.

16. The invention of claim 10 wherein said sizing cut out is approximately five inches wide.

17. The invention of claim 10 wherein said sizing cut out is approximately one and three quarter inches wide.

* * * * *